US008399390B2

(12) United States Patent
Wu et al.

(10) Patent No.: US 8,399,390 B2
(45) Date of Patent: Mar. 19, 2013

(54) HVI-PAO IN INDUSTRIAL LUBRICANT AND GREASE COMPOSITIONS

(75) Inventors: Margaret May-Som Wu, Skillman, NJ (US); Andrew Jackson, Pennington, NJ (US); Walter David Vann, Prairieville, LA (US); James Thomas Carey, Medford, NJ (US); Norman Yang, Westfield, NJ (US); Suzzy Chen Hsi Ho, Princeton, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1730 days.

(21) Appl. No.: 11/172,161

(22) Filed: Jun. 29, 2005

(65) Prior Publication Data

US 2007/0000807 A1 Jan. 4, 2007

(51) Int. Cl.
*C10M 143/00* (2006.01)

(52) U.S. Cl. ..... 508/591; 508/579; 585/10; 585/12; 208/19

(58) Field of Classification Search ..... 508/591; 585/10, 12
See application file for complete search history.

(56) References Cited

U.S. PATENT DOCUMENTS

| | | | | |
|---|---|---|---|---|
| 4,180,575 | A | 12/1979 | Rochling et al. | 424/250 |
| 4,827,064 | A | 5/1989 | Wu | 585/10 |
| 4,827,073 | A | 5/1989 | Wu | 585/530 |
| 4,912,272 | A | 3/1990 | Wu | 585/10 |
| 4,956,122 | A | 9/1990 | Watts et al. | 252/565 |
| 4,990,709 | A | 2/1991 | Wu | 585/10 |
| 4,990,771 | A | 2/1991 | Minoura et al. | 250/236 |
| 5,012,020 | A | 4/1991 | Jackson et al. | 585/10 |
| 5,264,642 | A | 11/1993 | Wu | 585/530 |
| 5,276,227 | A * | 1/1994 | Wu et al. | 585/12 |
| 6,087,307 | A | 7/2000 | Kaminski et al. | 508/223 |
| 6,180,575 | B1 | 1/2001 | Nipe | 508/227 |
| 6,395,948 | B1 * | 5/2002 | Hope et al. | 585/510 |
| 6,713,438 | B1 | 3/2004 | Baillargeon et al. | 508/463 |
| 6,824,671 | B2 | 11/2004 | Goze et al. | 208/19 |
| 6,858,767 | B1 | 2/2005 | DiMaio et al. | 585/521 |
| 7,312,185 | B2 * | 12/2007 | Willey et al. | 508/165 |
| 2004/0092408 | A1 | 5/2004 | Willey et al. | 508/165 |
| 2005/0059563 | A1 | 3/2005 | Sullivan et al. | 508/463 |

FOREIGN PATENT DOCUMENTS

| | | |
|---|---|---|
| EP | 0 088 453 | 9/1983 |
| WO | WO 03/009136 | 1/2003 |
| WO | WO 03/071369 | 8/2003 |

OTHER PUBLICATIONS

Rudnick et al., "Synthetic Lubricants and High-Performance Functional Fluids", 2nd Ed.Marcel Dekker, Inc., N.Y. pp. 499-538, (1999).
Journal of the Society of Tribologists and Lubrication Engineers, 55/8, p. 45 (1999).

* cited by examiner

*Primary Examiner* — Ellen McAvoy
(74) *Attorney, Agent, or Firm* — Nancy T. Krawczyk; Andy B. Griffis; Leandro Arechederra, III

(57) ABSTRACT

The invention relates to industrial lubricant and grease compositions containing high viscosity index polyalphaolefins (HVI-PAO). The use of HVI-PAOs in industrial oils and greases application provides advantages in improved shear stability, wear property, foam property, energy efficiency and improved overall performance.

13 Claims, No Drawings

HVI-PAO IN INDUSTRIAL LUBRICANT AND GREASE COMPOSITIONS

FIELD OF THE INVENTION

The invention relates to industrial lubricant and grease compositions containing high viscosity index polyalphaolefins (HVI-PAO).

BACKGROUND OF THE INVENTION

Polyalphaolefins (PAOs) of different viscosity grades are known to be useful in synthetic and semi-synthetic industrial oil and grease formulations. See, for instance, Chapters 22 and 23 in Rudnick et al., "Synthetic Lubricants and High-Performance Functional Fluids", 2nd Ed. Marcel Dekker, Inc., N.Y. (1999). Compared to the conventional mineral oil-based products, these PAO-based products have excellent viscometrics, high and low temperature performance and energy efficiency under routine conditions and ordinary replacement schedules.

The viscosity-temperature relationship of a lubricating oil is one of the critical criteria, which must be considered when selecting a lubricant for a particular application. Viscosity Index (VI) is an empirical, unitless number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication films and better protection of the contacting machine elements. In another aspect, as the oil operating temperature decreases, the viscosity of a high VI oil will not increase as much as the viscosity of a low VI oil. This is advantageous because the excessively high viscosity of the low VI oil will decrease the efficiency of the operating machine. Thus a high VI oil has performance advantages in both high and low temperature operation. VI is determined according to ASTM method D 2270-93 [1998]. VI is related to kinematic viscosities measured at 40° C. and 100° C. using ASTM Method D 445-01.

PAOs comprise a class of hydrocarbons manufactured by the catalytic oligomerization (polymerization to low molecular weight products) of linear α-olefins typically ranging from 1-hexene to 1-octadecene, more typically from 1-octene to 1-dodecene, with 1-decene as the most common and often preferred material. Examples of these fluids are described, by way of example, in U.S. Pat. Nos. 6,824,671 and 4,827,073, although polymers of lower olefins such as ethylene and propylene may also be used, especially copolymers of ethylene with higher olefins, as described in U.S. Pat. Nos. 4,956,122 or 4,990,709 and the patents referred to therein.

High viscosity index polyalphaolefin (HVI-PAO) are prepared by, for instance, polymerization of alpha-olefins using reduced metal oxide catalysts (e.g., chromium) such as described in U.S. Pat. Nos. 4,827,064; 4,827,073; 4,990,771; 5,012,020; and 5,264,642. These HVI-PAOs are characterized by having a high viscosity index (VI) and one or more of the following characteristics: a branch ratio of less than 0.19, a weight average molecular weight of between 300 and 45,000, a number average molecular weight of between 300 and 18,000, a molecular weight distribution of between 1 and 5, and pour point below −15° C. Measured in carbon number, these molecules range from C30 to C1300. Viscosities of the HVI-PAO oligomers measured at 100° C. range from 3 centistokes ("cSt") to 15,000 cSt. These HVI-PAOs have been used as basestocks since their commercial production and are commercially available, such as for instance SpectraSyn Ultra™ fluid, from ExxonMobil Chemical Co.

Another advantageous property of these HVI-PAOs is that, while lower molecular weight unsaturated oligomers are typically and preferably hydrogenated to produce thermally and oxidatively stable materials, higher molecular weight unsaturated HVI-PAO oligomers useful as lubricant are sufficiently thermally and oxidatively stable to be utilized without hydrogenation and, optionally, may be so employed.

HVI-PAO materials have been used for formulating oils for internal combustion engines. By way of example, WO 00/58423 teaches high performance oil comprising a first and second polymer of differing molecular weights dissolved in a basestock of low viscosity. The first polymer is a high viscoelastic polymer, preferably an HVI-PAO. The basestock used generally has a viscosity of below 10 cSt at 100° C. The HVI-PAO is "normally present in relatively small amounts", e.g., 0.1 to about 25 wt % in the total finished product. Also included in the finished product is a polymeric thickener, normally based on block copolymers produced by the anionic polymerization of unsaturated monomers including styrene, butadiene, and isoprene. A "conventional" additive package, containing dispersant, detergents, anti-wear, or antioxidants such as phenolic and/or amine type antioxidants is also added.

See also U.S. Pat. Nos. 4,180,575; 4,827,064; 4,827,073; 4,912,272; 4,990,771; 5,012,020; 5,264,642; 6,087,307; 6,180,575; WO 03/09136; WO 2003071369A; U.S. Patent Application No. 2005/0059563; and Lubrication Engineers, 55/8, 45 (1999).

Industrial gear oils have to meet the following requirements: excellent resistance to aging and oxidation, low foaming tendency, good load-carrying capacity, neutrality toward the materials involved (ferrous and nonferrous metals, seals, paints), suitability for high and/or low temperatures, and good viscosity-temperature behavior; gear greases, in contrast, are required to ensure the following: good adhesion, low oil separation, low starting torques, compatibility with synthetic materials, and noise dampening (c.f., Rudnick et al., supra). Heretofore, a universal gear lubricant meeting all these requirements is not, as far as the present inventors are aware, commercially available. This requires that lubricant manufacturers develop different types of formulations with properties satisfying individual operating needs for each application.

The present inventors have surprisingly discovered a novel industrial lubricant and grease composition comprising a high viscosity index polyalphaolefin (HVI-PAO).

SUMMARY OF THE INVENTION

The invention is directed to oil and grease formulations for industrial use comprising a high viscosity index polyalphaolefin (HVI-PAO).

The HVI-PAOs useful in the present invention are characterized by having a high viscosity index (VI), preferably 130 or greater, more preferably greater than 160, and still more preferably 165 or greater, as measured by ASTM D2270, and one or more of the following characteristics: a branch ratio of less than 0.19, a weight average molecular weight of between 300 and 45,000, a number average molecular weight of between 300 and 18,000, a molecular weight distribution of between 1 and 5, and pour point below −15° C. In an embodiment, these HVI-PAOs may be further characterized by carbon number ranging from C30 to C1300. In another embodiment, these HVI-PAOs may be characerized by kinematic viscosities measured at 100° C. ranging from 3 centistokes ("cSt") to 15,000 cSt, as measured by ASTM D445.

In embodiments, the HVI-PAOs useful in the present invention may be prepared by non-isomerization polymerization of alpha-olefins using reduced metal oxide catalysts (e.g., reduced chromium on silica gel), zeolite catalysts, activated metallocene catalysts, or Zeigler-Natta ("ZN") catalyst.

In preferred embodiments, the formulations according to the present invention are used as gear oils, circulating oils, compressors oils, hydraulic oils, refrigeration lubes, metal-working fluids and greases.

In an embodiment the formulations according to the invention further comprise one or a mixture of several grades of the HVI-PAO by itself or with at least one ingredient selected from PAOs, polymers or oligomers from ethylene/alphaolefins, esters, polyethers, polyether esters, alkylaromatic fluids, suitable polyalkylene glycols, Group I base stocks, Group II or Group III hydroprocessed base stocks, or lubricants derived from hydroisomerized waxy stocks (such as slack wax or waxy Fischer-Tropsch hydrocarbons, for example), or other suitable lubricant base stocks.

In another embodiment, the formulations also comprise one or more of additives selected from anti-oxidants, viscosity modifiers, pour point depressants, anti-wear agents, extreme pressure additives, defoamants or antifoamants, friction modifiers, dispersants, detergents, corrosion inhibitors, tackifiers, seal swell additives, biocides, demulsifiers, and metal passivators. However, a particular advantage of formulations according to the present invention is that certain conventional additives for industrial lubricants and greases are not required, particularly polymeric thickeners or other thickening fluids, e.g., polyisobutylenes, conventional poly-alpha-olefins (PAO) or VI improvers.

It is an object of the invention to provide formulations useful as industrial oils and/or greases having one or more of the following characeristics: high thermal and oxidative stabilities, low friction, superior anti-wear property, shear stability, energy efficiency, low foaming property, low traction, long-term property stability even after use or aging, and excellent water separability properties and demulsibility properties.

It is another object of the invention to provide industrial oil and/or greases having one or more performance improvements selected from operation lifetime, energy efficiency, machine protection and reliability.

These and other objects, features, and advantages will become apparent as reference is made to the following detailed description, preferred embodiments, specific examples, and appended claims.

DETAILED DESCRIPTION

According to the invention, formulations for use as industrial oils and greases are provided comprising a high viscosity index PAO (HVI-PAO).

The HVI-PAOs useful in the present invention are characterized by having a high viscosity index (VI), preferably 130 or greater, more preferably greater than 160, and still more preferably 165 or greater, yet more preferably 200 or greater, and yet still more preferably 250 or greater. An upper limit on VI, while not critical to the characterization of HVI-PAOs useful in the present inventioin, is about 350. VI as used herein are measured according to ASTM D2270.

The HVI-PAOs generally can be further characterized by one or more of the following: C30-C1300 hydrocarbons, a branch ratio of less than 0.19, a weight average molecular weight of between 300 and 45,000, a number average molecular weight of between 300 and 18,000, a molecular weight distribution of between 1 and 5.

Particularly preferred HVI-PAOs are fluids with 100° C. kinematic viscosity ranging from 5 to 3000 centistokes (cSt). The term "kinematic viscosity" as used herein will be referred to simply as viscosity, unless otherwise noted, and will be the viscosity determined according to ASTM D445 at the temperature specified, usually 100° C. When no temperature is mentioned, 100° C. should be inferred.

In embodiments, viscosities of the HVI-PAO oligomers measured at 100° C. range from 3 cSt to 15,000 cSt, or 3 cSt to 5,000 cSt, or 3 cSt to 1000 cSt, or 725 cSt to 15,000 cSt, or 20 cSt to 3000 cSt.

The HVI-PAOs may be further characterized, in an embodiment, by a low pour point, generally below −15° C., as determined by ASTM D97.

The term "PAO" in HVI-PAOs means, as is generally accepted in the art, an oligomer (low molecular weight polymer) of one or more alpha olefins, such as 1-decene. In embodiments, the HVI-PAOs of the invention may be further characterized as hydrocarbon compositions comprising the oligomers of one or more 1-alkenes selected from C6-C36 1-alkenes, more preferably C6-C20, still more preferably C6-C14. Examples of the feeds can be 1-hexene, 1-octene, 1-decene, 1-dodecene, 1-tetradecene, etc., or mixtures thereof, such as one or more of C6 to C36 1-alkenes, or one or more C6 to C20 1-alkenes, or one or more C6 to C14 alkenes, or mixtures of specific 1-alkenes, such as a mixture of C6 and C12 1-alkenes, a mixture of C6 and C14 1-alkenes, a mixture of C6 and C16 1-alkenes, a mixture of C6 and C18 1-alkenes, a mixture of C8 and C10 1-alkenes, a mixture of C8 and C12 1-alkenes, or a feed comprising at least two 1-alkenes selected from the group consisting of C8, C10 and C12 1-alkenes, and so forth, although oligomers of lower olefins such as ethylene and propylene may also be used, including copolymers of ethylene with higher olefins, as described in U.S. Pat. No. 4,956,122.

Preferred methods of making the HVI-PAO fluids useful in the present invention can be made from several process catalysts. Example catalysts are supported solid reduced Group VIB metal (e.g. chromium) catalyst under oligomerization conditions at a temperature of about room temperature to 250° C., or metallocene catalysts. Numerous patents describe the preparation of HVI-PAO useful in the present invention, such as U.S. Pat. Nos. 4,827,064; 4,827,073; 4,912,272; 4,914,254; 4,926,004; 4,967,032; and 5,012,020. Additional methods of preparing a HVI-PAO useful in the present invention are described herein.

In preferred embodiments for preparation of HVI-PAOs useful in the present invention, the lube products usually are distilled to remove any low molecular weight compositions such as those boiling below about 600° F. (about 315° C.), or with carbon number less than C20, if they are produced from the polymerization reaction or are carried over from the starting material. This distillation step usually improves the volatility of the finished fluids. In certain special applications, or when no low boiling fraction is present in the reaction mixture, this distillation is not necessary. Thus, in preferred embodiments, the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D2710) or other suitable analytical methods, such as NMR, IR, and the like, well-known per se to one of ordinary skill in the art. The amount of the double bond or the amount of olefinic compositions depends on several factors—the degree of polymerization, the amount of hydrogen present during the polymerization process and the amount of other promoters which participate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

Oxidative stability and light or UV stability of fluids usually improves when the amount of unsaturation double bonds or olefinic contents is reduced. Therefore in preferred embodiments, it is necessary to further hydrotreat the polymer if they have high degree of unsaturation. Usually, the fluids with bromine number of less than 5, as measured by ASTM D1159, is suitable for high quality base stock applications of the invention. Fluids with bromine number of less than 3 or 2 are preferred. The most preferred range is less than 1 or less than 0.1.

In embodiments, the lube products in the production of the HVI-PAOs are hydrotreated to reduce unsaturation. This may be done by methods well-known per se in literature (e.g., U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, the direct product may be used without hydrotreating. Thus, hydrotreatment of the HVI-PAO product is optional, depending on the method used to make the HVI-PAO and the end use.

The present invention also comprises lubricant compositions containing lubricant base stocks and additives per se known to be useful for industrial lubricant application and greases.

Industrial lubricants comprise a wide variety of products. Examples of industrial lubricants are gear lubrication oils, hydraulic oils, compressor oils, circulation oils, paper machine oils, and the like.

Depending on applications, industrial lubricants can have wide viscosity range, from 2 cSt to 1650 cSt at 100° C., which are much wider than the viscosity specifications for automotive engine oils. For most industrial oils, viscosity is a significant criterion. General machinery oils are classified according to ISO Standard 3448 viscosity specification.

Viscosities of base stocks used to formulate industrial lubricants have critical effect on finished lubricant performance for industrial machinery application. For example, high speed and lightly loaded plain bearings can use a low viscosity lubricant. The viscosity film generated by such low viscosity fluid is enough to ensure hydrodynamic lubrication. However, higher loadings and lower speed equipment requires higher viscosity oils to provide stronger and thicker lubricating film for protection. There are many ways to achieve wide viscosity range, blending of commonly available low viscosity fluids, such as the 100 SUS solvent-refined base stocks or low viscosity Group IV or Group V base stocks, with high viscosity fluids, such as the commonly available bright stock, high viscosity PAO, such as SpectraSyn™ 100 fluid, high viscosity polyisobutylenes, or with viscosity improvers or viscosity index improvers. The quality of the high viscosity base stock is critical to the property and the performance of the finished lubricants.

The lube base stocks used in industrial lubricant formulations comprise at least some amount of single viscosity grade or a mixture of several viscosity grades of HVI-PAO fluids. The total HVI-PAO composition can ranged from 1% to 99 wt %, depending on the desirable viscosity grades of the finished lube, the starting viscosity grade of the HVI-PAO or the viscosities of other components present in the finished lube. In preferred embodiments, the amount of HVI-PAO present can range from 1 to 90 wt %, or 15 to 50 wt %, or 15 to 45 wt %, or 50 to 99 wt %, or 50 to 90 wt %, or 55 to 90 wt %

Basestocks that may be blended with the HVI-PAOs of the invention include those that fall into any of the well-known American Petroleum Institute (API) categories of Group I through Group V. The API defines Group I stocks as solvent-refined mineral oils. Group I stocks contain the least saturates and highest amount of sulfur and generally have the lowest viscosity indices. Group I defines the bottom tier of lubricant performance. Group II and III stocks are high viscosity index and very high viscosity index base stocks, respectively. The Group III oils generally contain fewer unsaturates and sulfur than the Group II oils. With regard to certain characteristics, both Group II and Group III oils perform better than Group I oils, particularly in the area of thermal and oxidative stability.

Group IV stocks consist of polyalphaolefins, which are produced via the catalytic oligomerization of linear alphaolefins (LAOs), particularly LAOs selected from C5-C14 alphaolefins, preferably from 1-hexene to 1-tetradecene, more preferably from 1-octene to 1-dodecene, and mixtures thereof, with 1-decene being the preferred material, although oligomers of lower olefins such as ethylene and propylene, oligomers of ethylene/butene-1 and isobutylene/butene-1, and oligomers of ethylene with other higher olefins, as described in U.S. Pat. No. 4,956,122 and the patents referred to therein, and the like may also be used. PAOs offer superior volatility, thermal stability, and pour point characteristics to those base oils in Group I, II, and III.

Group V includes all the other base stocks not included in Groups I through IV. Group V base stocks includes the important group of lubricants based on or derived from esters. It also includes alkylated aromatics, polyalkylene glycols (PAGs), etc.

Particularly preferred base stocks to blend with HVI-PAO include the API Group I base stocks with viscosity ranging from 3 cSt to 50 cSt, Group II and III hydroprocessed base stocks (see, for example, U.S. Pat. Nos. 5,885,438, 5,643,440, and 5,358,628), Group IV PAOs such as those described in U.S. Pat. Nos. 4,149,178, and 3,742,082, and fluids prepared from polymerization of internal olefins (also named polyinternal olefins or PIO), or lubes produced from Fischer-Tropsch hydrocarbon synthesis process followed by suitable hydroisomerization process as described in U.S. Pat. No. 6,332,974.

In embodiments, one or more of the aforementioned Group I to V basestocks may be blended with the HVI-PAO of the present invention, in the amount of 1% to 99 wt %, in embodiments from 1 to 90 wt %, or 50 to 99 wt %, or 55 to 90 wt %, or 1 to 50 wt %, or 1 to 45 wt %, or 5 to 50 wt %, or 5 to 45 wt %. Often, one or multiple of these other base stocks are chosen to blend with HVI-PAO to obtain the optimized viscometrics and the performance. Further, preferred embodiments relate to the viscosity index of the base stocks usable as blending components in this invention, where in some instances the viscosity index is preferably 80 or greater, more preferably 100 or greater, and even more preferably 120 or greater. Additionally, in certain particular instances, viscosity index of these base stocks may be preferably 130 or greater, more preferably 135 or greater, and even more preferably 140 or greater In addition to these fluids described above, in a preferred embodiment a second class of fluids, selected to be different from the fluids discussed above, and preferably having a higher polarity is also added to the formulation. The polarity of a fluid may be determined by one of ordinary skill in the art, such as by aniline points as measured by ASTM D611 method. Usually fluids with higher polarity will have lower aniline points. Fluids with lower polarity will have higher aniline points. Most polar fluids will have aniline points of less than 100° C. In preferred embodiments, such fluids are selected from the API Group V base stocks. Examples of these Group V fluids include alkylbenzenes (such as those described in U.S. Pat. Nos. 6,429,345, 4,658,072), and alkylnaphthalenes (e.g., U.S. Pat. Nos. 4,604,491, and 5,602,086). Other alkylated aromatics are described in "Synthetic Lubricants and High Performance Functional Fluids", M. M Wu, Chapter 7, (L. R. Rudnick and R. L. Shubkin [ed.)), Marcel Dekker, N.Y. 1999.

Also included in this class and with very desirable lubricating characteristics are the alkylated aromatic compounds including the alkylated diphenyl compounds such as the alkylated diphenyl oxides, alkylated diphenyl sulfides and alkylated diphenyl methanes and the alkylated phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; 5,371,248 and EP 815187.

Other Group V fluids that are suitable for use as blend components include polyalkylene glycols (PAGs), partially or fully ether- or ester end-capped PAGs. Ester base stocks may also used as co-base stocks in formulations according to the invention. These esters can be prepared, for instance, by dehydration of mono-acids, di-acids, tri-acids with alcohols with mono-, di- or multi-alcohols. Preferred acids include C5-C30 monobasic acids, more preferably 2-ethylhexanoic acid, isoheptyl, isopentyl, and capric acids, and di-basic acids, more preferably adipic, fumaric, sebacic, azelaic, maleic, phthalic, and terephthalic acids. The alcohols can be any of the suitable mono-alcohols or polyols. Preferred examples are 2-ethylhexanol, iso-tridecanols, neopentyl glycol, trimethylol ethane, 2-methyl-2-propyl- 1,3-propanediol, trimethylol propane, pentaerythritol, and dipentaerythritol. Preparation, properties and use of these alcohols are summarized in Chapter 3 of Rudnick et al., supra.

The secondary component of the base stock, if used, is typically used in an amount of about 1 wt % up to no more than about 50 wt % of the total composition, and in embodiments from about 1 wt % up to no more than about 20 wt %. This contrasts with automotive gear applications, wherein up to 75% of formulations comprises similar components. Alkyl naphthalenes are preferably used in amounts from about 5 to about 25 wt %, preferably about 10 to about 25 wt. %. Alkylbenzenes and other alkyl aromatics may be used in the same amounts although it has been found that the alkylnaphthalenes in some lubricant formulations are superior in oxidative performance in certain applications. PAG or esters are usually used in amount of about 1 wt % to no more than about 40 wt %, in embodiments no more than 20 wt % and in other embodiments less than 10 wt % or even less than 5 wt %.

The present inventors have found that using these secondary Group V base stocks usually improve one or several of the finished lubricant product properties, such as the viscosity, solvency, seal swell, clarity, lubricity, oxidative stability, and the like, of the finished lubricant products.

The viscosity grade of the final product is adjusted by suitable blending of base stock components of differing viscosities. In many conventional industrial lubricant formulations, thickeners are used to increase viscosity. One particular advantage of the present invention is that thickeners are not necessary and in preferred embodiments no thickeners are used. HVI-PAO fluids of different viscosity grades are most suitably used to achieve wide finished viscosity grades with significant performance advantages. Usually, differing amounts of the various basestock components (primary hydrocarbon base stocks, secondary base stock and any additional base stock components) of different viscosities, may be suitably blended together to obtain a base stock blend with a viscosity appropriate for blending with the other components (such as described below) of the finished lubricant. This may be determined by one of ordinary skill in the art in possession of the present disclosure without undue experimentation. The viscosity grades for the final product are preferably in the range of ISO 2 to ISO 1000 or even higher for industrial gear lubricant applications, for example, up to about ISO 46,000. For the lower viscosity grades, typically from ISO 2 to ISO 100, the viscosity of the combined base stocks will be slightly higher than that of the finished product, typically from ISO 2 to about ISO 220 but in the more viscous grades up to ISO 46,000, the additives will frequently decrease the viscosity of the base stock blend to a slightly lower value. With a ISO 680 grade lubricant, for example, the base stock blend might be about 780-800 cSt (at 40° C.) depending on the nature and content of the additives.

In conventional formulations, the viscosity of the final product may be brought to the desired grade by the use of polymeric thickeners especially in the product with the more viscous grades, e.g. from ISO 680 to ISO 46,000. Typical thickeners which may be used include the polyisobutylenes, as well as ethylene-propylene polymers, polymethacrylates and various diene block polymers and copolymers, polyolefins and polyalkylstyrenes. These thickeners are commonly used as viscosity index improvers (VIs) or viscosity index modifiers (VIMs) so that members of this class conventionally confer a useful effect on the temperature-viscosity relationship. Although optionally used in formulations according to the present invention, such components may be blended according commercial market requirement, equipment builder specifications to produce products of the final desired viscosity grade. Typical commercially available viscosity index improvers are polyisobutylenes, polymerized and copolymerized alkyl methacrylates, and mixed esters of styrene maleic anhydride interpolymers reacted with nitrogen containing compounds.

The polyisobutenes, normally with a number average or weight average molecular weight from 10,000 to 15,000, are a commercially important class of VI improvers and generally confer strong viscosity increases as a result of their molecular structure. The diene polymers which are normally copolymers of 1,3-dienes such as butadiene or isoprene, either alone or copolymerized with styrene are also an important class commercially, with typical members of this class sold under names such as Shelivis™. The statistical polymers are usually produced from butadiene and styrene while the block copolymers are normally derived from butadiene/isoprene and isoprene/styrene combinations. These polymers are normally subjected to hydrogenation to remove residual diene unsaturation and to improve stability. The polymethacrylates, normally with number average or weight average molecular weights from 15,000 to 25,000, represent another commercially important class of thickeners and are widely commercially available under designations such as Acryloid™.

One class of polymeric thickeners is the block copolymers produced by the anionic polymerization of unsaturated monomers including styrene, butadiene, and isoprene. Copolymers of this type are described, for instance, in U.S. Pat. Nos. 5,187,236; 5,268,427; 5,276,100; 5,292,820; 5,352,743; 5,359,009; 5,376,722 and 5,399,629. Block copolymers may be linear or star type copolymers and for the present purposes, the linear block polymers are preferred. The preferred polymers are the isoprene-butadiene and isoprene-styrene anionic diblock and triblock copolymers. Particularly preferred high molecular weight polymeric components are the ones sold under the designation Shelivis™ 40, Shelivis™ 50 and Shelivis™ 90 by Infenium Chemical Company, which are linear anionic copolymers. Of these, Shelivis™ 50 is an anionic diblock copolymer and Shelivis™ 200, Shelivis™ 260 and Shelivis™ 300 are star copolymers.

Some thickeners may be classified as dispersant-viscosity index modifiers because of their dual function, as described in U.S. Pat. No. 4,594,378. The dispersant-viscosity index modifiers disclosed in the '378 patent are the nitrogen-containing esters of carboxylic-containing interpolymers and the oil-soluble acrylate-polymerization products of acrylate esters, alone or in combination. Commercially available dispersant-viscosity index modifiers are sold under trade names Acryloid™ 1263 and 1265 by Rohm and Haas, Viscoplex™ 5151 and 5089 by Rohm-GMBHO™ Registered TM and Lubrizol™ 3702 and 3715.

Antioxidants, although optional, may be used to improve the oxidative stability of formulations according to the present invention. A wide range of commercially available materials is suitable. The most common types of antioxidant which may be used in the present compositions are the phenolic antioxidants, the amine type antioxidants, the alkyl aromatic sulfides, phosphorus compounds such as the phosphites and phosphonic acid esters and the sulfur-phosphorus compounds such as the dithiophosphates and other types such as the dialkyl dithiocarbamates, e.g. methylene bis(di-n-butyl) dithiocarbamate. They may be used individually by type or in combination with one another. Mixtures of different types of phenols or amines are particularly preferred.

The preferred sulfur compounds which are optionally added to compositions according to the present invention for improved antioxidant performance include the dialkyl sulfides such as dibenzyl sulfide, polysulfides, diaryl sulfides, modified thiols, mercaptobenzimidazoles, thiophene derivatives, xanthogenates, and thioglycols.

Phenolic antioxidants which may be used in the present lubricants may suitably be ashless (metal-free) phenolic compounds or neutral or basic metal salts of certain phenolic compounds. The amount of phenolic compound incorporated into the lubricant fluid may vary over a wide range depending upon the particular utility for which the phenolic compound is added. In general, from about 0.1 to about 10% by weight of the phenolic compound will be included in the formulation. More often, the amount is from about 0.1 to about 5%, or about 1 wt % to about 2 wt %. Percentages used herein are based on the total formulation unless otherwise specified.

The preferred phenolic compounds are the hindered phenolics which are the ones which contain a sterically hindered hydroxyl group, and these include those derivatives of dihydroxy aryl compounds in which the hydroxyl groups are in the o-or p-position to each other. Typical phenolic antioxidants include the hindered phenols substituted with C6 alkyl groups and the alkylene coupled derivatives of these hindered phenols. Examples of phenolic materials of this type is 2-t-butyl4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6di-t-butyl-4-heptyl phenol; and 2-methyl-6-di-t-butyl-4-dodecyl phenol. Examples of ortho coupled phenols include: 2,2'-bis(6t-butyl-4-heptyl phenol); 2,2'-bis(6-t-butyl-4-octyl phenol); and 2,2'-bis(6-t-butyl4-dodecyl phenol). Sulfur containing phenolics can also be used to great advantage. The sulfur can be present as either aromatic or aliphatic sulfur within the phenolic antioxidant molecule.

Non-phenolic oxidation inhibitors, especially the aromatic amine antioxidants may also be used either as such or in combination with the phenolics. Typical examples of non-phenolic antioxidants include: alkylated and non-alkylated aromatic amines such as the aromatic monoamines of the formula $R^3R^4R^5N$ where $R^3$ is an aliphatic, aromatic or substituted aromatic group, $R^4$ is an aromatic or a substituted aromatic group, and R is H, alkyl, aryl or $R^6S(O)xR^7$ where $R^6$ is an alkylene, alkenylene, or aralkylene group, $R^7$ is a higher alkyl group, or an alkenyl, aryl, or alkaryl group, and x is 0, 1 or 2. The aliphatic group $R^3$ may contain from 1 to about 20 carbon atoms, and preferably contains from 6 to 12 carbon atoms. The aliphatic group is a saturated aliphatic group. Preferably, both $R^3$ and $R^4$ are aromatic or substituted aromatic groups, and the aromatic group may be a fused ring aromatic group such as naphthyl. Aromatic groups $R^3$ and $R^4$ may be joined together with other groups such as S.

Typical aromatic amines antioxidants have alkyl or aryl substituent groups of at least 6 carbon atoms. Examples of aliphatic groups include hexyl, heptyl, octyl, nonyl, and decyl. Examples of aryl groups include styrenated or substituted-styrenated groups. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyidiphenylamine; octylphenyl-beta-naphthylamine; t-octylphenyl-alpha-naphthylamine; phenyl-alphanaphthylamine; phenyl-beta-naphthylamine; p-octyl phenyl-alpha-naphthylamine; 4-octylphenyl-1-octyl-beta-naphthylamine.

Typical of the dialkyl dithiophosphate salts which may be used are the zinc dialkyl dithiophosphates, especially the zinc dioctyl and zinc dibenzyl dithiophosphates. These salts are often used as anti-wear agents but they have also been shown to possess antioxidant functionality, especially when used as a co-antioxidant in combination with an oil-soluble copper salt. Copper salts which may be used in this way as antioxidants in combination with the phosphorus and zinc compounds such as zinc dialkyl dithiophosphates include the copper salts of carboxylic adds such as stearic add, palmitic acid and oleic acid, copper phenates, copper sulfonates, copper acetylacetonates, copper naphthenates from naphthenic acids typically having a number average or weight average molecular weight of 200 to 500 and the copper dithiocarbamates and copper dialkyl dithiophosphates where the copper has been substituted for zinc. Copper salts of this type and their use as antioxidants are described in U.S. Pat. No. 4,867,890.

Normally, the total amount of antioxidant will not exceed 10 wt. % of the total composition and normally is rather less, below 5 wt. %. Usually, from 0.5 to 2 wt. % antioxidant is suitable although for certain applications more may be used if desired.

Inhibitor Package

An inhibitor package is used to provide the desired balance of anti-wear and anti-rust/anti-corrosion properties. One component of this package is a substituted benzotriazole-lamine phosphate adduct and the other is a tri-substituted phosphate, especially a triaryl phosphate such as cresyl diphenylphosphate, a known material which is commercially available. This component is typically present in minor amounts up to 5 wt. % of the composition. Normally less than 3% e.g. from 0.5 to 2 wt. % of the total composition is adequate to provide the desired anti-wear performance.

The second component of the anti-wear/anti-rust package is an adduct of benzotriazole or a substituted benzotriazole with an amine phosphate adduct which also provides anti-wear and anti oxidation performance. Certain multifunctional adducts of this kind (with aromatic amines) are described in U.S. Pat. No. 4,511,481 to which reference is made for a description of these adducts together with the method by which they may be prepared. Briefly, these adducts comprise a substituted benzotriazole. i.e. an alkyl-substituted benzotriazole where the substituent R is hydrogen or lower alkyl, $C_1$ to $C_6$, preferably $CH_3$. The preferred triazole is tolyl triazole (TTZ). For convenience, this component will be referred to as TTZ here although other benzotriazoles may also be used, as described in U.S. Pat. No. 4,511,481.

The amine component of the adduct may be an aromatic amine phosphate salt of the formula set out in U.S. Pat. No. 4,511,481, i.e., a triazole adduct of an amine phosphate. Alternatively, the main component may be an aliphatic amine salt, for example, a salt of an organoacid phosphate and an alkylamine such as a dialkylamine. The alkyl amine phosphate adducts may be made in the same way as the aromatic amine adducts. A preferred salt of this kind is the mono-/di-hexyl acid phosphate salt of long chain ($C_{11}$-$C_{14}$) alkylamines which can be made into an adduct with TTZ in this way for use in the present compositions. The adduct can range from 1:3 to 3:1 (mole) with the preferred adduct having a 75:25 ratio (weight) of the TTZ and the long chain alky/organoacid phosphate salt.

The TTZ amine phosphate salt adduct is typically used in relatively small amounts below about 5 wt. % and normally from about 0.1 to 1 wt. %, e.g. about 0.25 wt. %, is adequate when used in combination with the trihydrocarbyl phosphate, e.g. cresyl diphenylphosphate, component in order to give a good balance of anti-wear and anti-rust properties. Normally the CDP and the TTZ adduct are used in a weight ratio from 2:1 to 5:1.

Additional anti-rust additives may also be used. Metal deactivators which are commercially available and useful for this purpose, include, for example, the N,N-disubstituted aminomethyl-1,2,4-triazoles, and the N,N-disubstituted amino methyl-benzotriazoles. The N,N-disubstituted aminomethyl-1,2,4-triazoles can be prepared by a known method, namely be reacting a 1,2,4-triazole with formaldehyde and an amine, as described in U.S. Pat. No. 4,734,209. The N,N-disubstituted aminomethyl-benzotriazole can be similarly obtained by reacting a benzotriazole with formaldehyde and an amine, as described in U.S. Pat. No. 4,701,273. Preferably, the metal deactivator is 1-[bis(2-ethylhexyl)aminomethyl]-1,2,4-triazole or 1-[bis(2-ethylhexyl)aminomethyl]-4-methylbenzotriazole (adduct of tolyltriazole:formaldehyde:di-2-ethylhexylamine (1:1:1 m)), which are commercially available. Other rust inhibitors which may be used to confer additional rust protection include the succinimde derivatives such as the higher alkyl substituted amides of dodecylene succinic acid, which are also commercially, the higher alkyl substituted amides of dodecenyl succinic acid such as the tetrapropenylsuccinic monoesters (commercially available) and imidazoline succinic anhydride derivatives, e.g. the imidazoline derivatives of tetrapropenyl succinic anhydride. Normally, these additional rust inhibitors will be used in relatively small amounts below 2 wt. % although for certain applications e.g. in paper-making machinery oils, amounts up to about 5 wt. % may be employed if necessary.

The oils may also include other conventional additives, according to particular service requirements, for example dispersants, detergents, friction modifiers, traction improving additives, demulsifiers, defoamants, chromophores (dyes), haze inhibitors, according to application, all of which may be blended according to conventional methods using commercially available materials.

As noted above, the present lubricating oils have superior properties and performance features. Examples of the good properties include—excellent viscometrics, high VI, low pour point, superior low temperature viscosities, thermal oxidative stability, etc. These properties can be measured by many standard or special test. Usually, the kinematic viscosity were measured by ASTM D445. VI can be calculated by ASTM D2270. Pour point of a lubricant can be measured by ASTM D97 method. Cloud point of lubricant can be measured by ASTM D2500 method. Saybolt Universal Viscosity can be calculated by ASTM D2161 method. Low temperature, low-shear-rate viscosity of many gear oils, transmission oils, industrial lubricants and engine oils can be measured by Brookfield viscometer according to the ASTM D2983 method. Alternatively, when a range of viscosities at low temperatures are required, a scanning Brookfield viscosity can be obtained according to ASTM D5133 method. Viscosity at high temperature high shear rate can be measured by D4624, D5481, or D4741 method.

Good antiwear characteristics are indicated by performance in the FZG Scuffing test (DIN 51534), with fail stage values of at least 8, more usually in the range of 9 to 13 or even higher. The FZG test is indicative of performance for steel-on-steel contact as encountered in normal gear sets; good performance in this test indicates that good spur gear performance can be expected. The higher FZG test values are typically achieved with the higher viscosity grade oils, e.g. ISO 100 and higher will have an FZG value of 12 or higher, even 13 or higher, in comparison with values of 9 to 12 for grades below ISO 100. Values of 13 or higher (A/16.6/90) or 12 and higher (A/8.3/140) may be achieved with ISO grades of 300 and higher.

The anti-wear performance may also be indicated by a 4-Ball (ASTM D 4172) wear test value of not more than 0.35 mm maximum scar diameter (steel on steel, 1 hr, 180 rpm, 54° C., 20 Kg/cm$^2$) with values of not more than 0.30 mm being readily attainable. 4-ball EP Weld values of 120 or higher, typically 150 or higher may be achieved. ASTM 4-Ball steel-on-bronze values of 0.07 mm (wear scar diameter) are typical.

The rust inhibition performance is indicated by a Pass in ASTM D 665B with synthetic sea water. Copper Strip Corrosion (ASTM D130) at 24 hours, 121° C., is typically 2A maximum, usually 1B or 2A.

Excellent high temperature oxidation performance is shown by a number of performance criteria including low viscosity change, low acid number change and low corrosion or sludge deposit. A catalytic oxidation test has been developed to evaluate all these important criteria in one single test. In this catalytic oxidation test, 50 ml. of oil is placed in a glass tube together with iron, copper, and aluminum catalysts and a weight lead corrosion specimen. The cell and its contents are placed in a bath maintained at 163° C. and 10 liters/hr of dried air is bubbled through the sample for 40 hours. The cell is removed from the bath and the catalyst assembly is removed from the cell. The oil is examined for the presence of sludge and the change in Neutralization Number (ASTM D 664) and Kinematic Viscosity at 100° C. (ASTM D 445) are determined. The lead specimen is cleaned and weighed to determine the loss in weight. Test values of no more than 5 mg. KOH (DELTA TAN, at 163° C., 120 hrs.) are characteristic of the present compositions with values below 3 mg. KOH or even lower frequently—typically less than 0 mg. KOH being obtainable. Viscosity increase in the catalytic oxidation test is typically not more than 15% and may be as low as 8-10%.

Good oxidation resistance is also shown by the TOST values attained (ASTM D943) of at least 8,000 hours, usually at least 10,000 hours, with TOST sludge (1,000 hours) being no more than 1 wt. percent, usually no more than 0.5 wt %. Oxidation stability can also be measured by other methods, such as ASTM D2272.

The superior shear stability of the oils described in this invention can also be measured by many shear stability tests. Examples are Kurt Orbahn diesel injector test (ASTM 3945) or ASTM D5275 method. Another test for the shear stability is the tapered roller bearing shear test (CEC L-45-T/C method). It can also be measured by a sonic shear stability test (ASTM D2603 method). Shear stability is important for many industrial oil operations. Higher shear stability means the oil does not lose its viscosity at high shear. Such shear-stable oil can offer better protection under more severe operation conditions. The oil compositions described in this invention have superior shear stability for industrial oil applications.

The tendency of lubricating oils to foam can be a serious problem in systems such as gearing, high volume pumping, circulating lubrication and splash lubrication, etc. Foam formation in lubricant oils may cause inadequate lubrication, cavitation and overflow loss of lubricant, leading to mechanical failure. Therefore, it is important to control the foam property of a lubricant oil. This is especially important for industrial lubricants. Many methods were developed to measure the foaming tendency of lubricant. For example, in a Mixmaster foam method, 550 gram of test oil is charged into the container of a heavy duty Mixmater blender. The beater of the blender was then agitated at 750 rpm for five minutes. The beater is stopped, lifted out of the oil and allow any oil to drain back into the container for 20 seconds. Then measure the total foam volume in ml. This is the foam volume at time 0 minutes. Then after 5, 10, 20, 30, 40, etc. minutes, measure the foam volume to judge how fast the foam volume dissipate. Usually the test oil has good foam property if it produces less foam at the end of the 5 minutes of agitation and/or the faster the foam dissipates after the agitation stops. The lubricant formulated using HVI-PAO usually have superior foam property. Furthermore, the aged or contaminated lubricants based on HVI-PAO also have much better foam property than conventional formulations. Other foaming tests include ASTM D892 method—Foam Characteristics of Lubricating Oils.

Energy efficiency is becoming a more important factor in modern machinery. Equipment builders are looking for ways to improve the equipment's energy efficiency, reduce power consumption, reduce friction loss, etc. For example, refrigerator builders, consumers and government agencies are demanding energy efficient compressors for refrigeration units. Government mandates minimum energy efficiency for automobiles. Gear operators are demanding more efficient gears with lower energy consumption, lower operating temperature, etc. A lubricant can affect the energy efficiency of a machinery system in many ways. For example, lower viscosity lubricants with specified protection level will have lower viscous drag, thus less energy loss and better efficiency. Lubricants with lower frictional coefficients usually have better energy efficiency. Lubricants that produce excessive foaming reduce the volumetric efficiency. For example, on the downstroke of the piston, the foamy layer is compacted. This compaction absorbs energy and thus reduces the energy available for useful work. The lubricants disclosed in this invention have many of these energy efficient characteristics.

Energy efficiency of industrial oil is best tested under operating conditions. Such comparisons can be meaningfully made by using side-by-side comparison. Examples of such results are reported in a paper "Development and Performance Advantages of Industrial, Automotive and Aviation Synthetic Lubricants" Journal of Synthetic Lubrication, [1] p. 6-33 by D. A. Law and J. R. Lohuis, J. Y Breau, A. J. Harlow and M. Rochette.

Applications

The lubricating oils or grease of the present invention may be used for the lubrication of rolling element bearings (e.g., ball bearings), gears, circulation lubrication system, hydraulics, compressors used to compress gas (such as reciprocating, rotary and turbo-type air compressors, gas turbine or other process gas compressors) or to compress liquids (such as refrigerator compressors), vacuum pump or metal working machinery, as well as electrical applications, such as for lubrication of electrical switch that produces an electrical arc during on-off cycling or for electrical connectors.

The lubricant or grease components disclosed in this invention are most suitable for applications in industrial machinery where one of more the following characteristics are desirable: wide temperature range, stable and reliable operation, superior protection, extended operation period, energy efficient. The present oils are characterized by an excellent balance of performance properties including superior high and low temperature viscosities, flowability, excellent foam property, shear stability, and improved anti-wear characteristics, thermal and oxidative stability, low friction, low traction. They may find utility as gear oils, bearing oil, circulating oils, compressor oils, hydraulic oils, turbine oils, grease for all kinds of machinery, as well as in other applications, for example, in wet clutch systems, blower bearings, wind turbine gear box, coal pulverizer drives, cooling tower gearboxes, kiln drives, paper machine drives and rotary screw compressors.

EXPERIMENTAL

The following examples are meant to illustrate the present invention and provide a comparison with other methods and the products produced therefrom. Numerous modifications and variations are possible and it is to be understood that within the scope of the appended claims, the invention may be practiced otherwise than as specifically described herein.

I. HVI-PAOs From Non-Metallocene Catalysts

Preparation of the HVI-PAOs set forth in Table 1 below was described in U.S. Pat. No. 4,827,064. In this process, fluids with 100° C. viscosity ranging from 5 to 3000 cSt were prepared in high yields. Three representative examples of these fluids used for product formulation were summarized in Table 1, below.

TABLE 1

| Properties of HVI-PAO | | | |
|---|---|---|---|
| | Sample 1 | Sample 2 | Sample 3 |
| 100° C. vis, cSt | 18.5 | 145 | 298 |
| VI | 165 | 214 | 246 |
| Pour Point, ° C. | −55 | −40 | −32 |

II. HVI-PAO by Metallocene Catalysts

Sample 4. To a 500 ml flask, charge toluene (20 grams), 1,3-dimethylcyclopentadienyl zirconium dichloride (0.01 gram) and 10% MAO in toluene solution (20.1 grams) under inert atmosphere. Add 1-decene (100 gram) slowly into the catalyst mixture from addition funnel while maintaining reaction temperature at 20-25° C. Let reaction mixture stir for 16 hours. Quench catalyst with 3 ml water and basic alumina. Filter to remove solids. Distill the liquid at 140° C/<1 millitorr to remove any C20 and lighter components to provide lube sample. The lube yield is 92 wt. %. The lube has the following properties: 100° C. Visc=312 cSt, 40° C. visc=3259 cSt and VI=250. This lube was further hydrogenated at standard typical hydrogenation conditions to give finished product.

Sample 5. This sample was prepared in a similar manner as Sample 4, except dimethysilyl bis[cyclopentadienyl]zirconium dichloride was used as catalyst. The lube product has the following properties: 100° C. Visc=8.96 cSt, 40° C. visc=49.32 cSt and VI=164. The lube after hydrogenation under standard conditions can be used in industrial lube formulation.

III. Fully Synthetic Hydraulic Oil Formulations

Fully synthetic hydraulic oils were formulated containing HVI-PAO made in Sample 3, above, together with other synthetic base stocks. Their properties are summarized in Example 1 to 3 in Table 2. In a comparative formulation Example 4 to 6, similar synthetic hydraulic oils were formulated using a high viscosity PAO, SpectraSyn™ 40, available from ExxonMobil Chemical Co., together with the same synthetic base stocks used in Examples 1 to 3. These other basestocks included standard basestocks typically added to commercial products and include low viscosity ester fluids of 2 to 6 cSt in 20 to 30 wt % and low viscosity PAO fluids of 3 to 7 cSt in 20 to 70 wt %. The exact viscosity grades and the amounts of the low viscosity ester and PAO fluids were chosen to meet the specification of the finished lubricant viscosity grades, which is fully within the skill of the ordinary artisan.

In all the formulations, a standard additive package containing proper balance of amine and phenolic antioxidants, de-foamants, corrosion inhibitor, rust inhibitor, metal deactivators, anti-wear agents and detergent/dispersants was used.

The hydraulic oils based on the new HVI-PAO (Example 1 to 3) have VI more than 200, which is about 60 units higher than the VI of comparative oils (Example 4 to 6). Furthermore, the predicted viscosities at 150° C. for oil Examples 1-3 are higher than those for oil Example 4-6. The predicted low temperature viscosity at −40° C. for Examples 1-3 are much lower than those of Examples 4-6. Yet, Example 1 to 3 oils have comparable shear stability as comparative example, as measured by Kurt Orbhan shear stability test (ASTM D3945).

This set of examples demonstrated that, at the same shear stability level, oils formulated with the new base stocks have much improved high and low temperature properties than oil formulated with commercial PAO, as indicated by higher VI and more stable high and low temperature viscosities.

TABLE 2

| Lube properties of fully synthetic hydraulic oils | | | | | | |
|---|---|---|---|---|---|---|
| | Example | | | | | |
| | 1 | 2 | 3 | 4 | 5 | 6 |
| ISO vis grade | 32 | 46 | 100 | 32 | 46 | 100 |
| Wt % Sample 3 HVI-PAO | 18 | 23 | 40 | 0 | 0 | 0 |
| Wt % conventional PAO | 0 | 0 | 0 | 5 | 20 | 52 |
| Wt % Other base stocks (a) | balance | balance | balance | balance | balance | Balance |
| Wt % Additives (b) | 2.81 | 2.81 | 2.81 | 2.81 | 2.81 | 2.81 |
| Visc at 40° C., cSt | 35.6 | 45.0 | 103.8 | 32.0 | 45.9 | 103.2 |
| Visc at 100° C., cSt | 7.96 | 9.76 | 20.0 | 6.10 | 8.02 | 14.82 |
| VI | 206 | 210 | 217 | 141 | 148 | 149 |
| Predicted Visc at 150° C., cSt | 3.77 | 4.53 | 8.59 | 2.78 | 3.50 | 5.85 |
| Predicted Visc at −40° C., cSt | 4730 | 5890 | 14130 | 14016 | 23868 | 78257 |
| % 100° C. visc loss (ASTM D3945) | 0.21 | −0.34 | 1.45 | 0.44 | 0.18 | 0.40 |

(a) - Other base stocks including 30 wt % ester fluid of 2.7 cS ester fluid. The remaining balance is a 4 cS PAO fluid.

(b) The additive package is a typical hydraulic additive package containing proper balanced amount of phenolic or aromatic amine type antioxidant, antiwear additives, such as ZDDP, friction modifiers and/or corrosion inhibitor. Examples of additives used in literature can be found in U.S. Pat. No. 4,537,696, although the exact components and concentration used here are different from the previous example.

IV. Semi-Synthetic Hydraulic Oil Formulations

The HVI-PAO can also be used to blend with conventional mineral oil to give semi-synthetic lubricants with performance advantages over conventional viscosity improver. Semi-synthetic hydraulic oil formulations were formulated, Example 7 and 8 (Table 3), using a different amount of Sample 2, above, a 145 cSt oil, to give two viscosity grades. Example 7 is lower vis grade. Example 8 is higher vis grade. The example 7 oil has comparable viscosity grade to the two commercial hydraulic oils (Example 9 and 10), using a conventional VI improver, Acryloid™ 956 available from Rohm and Haas. In all these examples, the remaining components are conventional mineral oil which is a solvent refined paraffinic neutral 100 SUS mineral oil. In example 7, a small amount of a 60 SUS naphthenic oil was added in order to bring the viscosity and VI to be comparable to example 9 and 10. These mineral oil base stocks are commonly available from any of the major lubricant refiners or distributors. When all these lubricants were subjected to Tapered Roller Bearing (TRB) Shear Test (a standard CEC L-45-T/C test), Example 7 and 8 based on HVI-PAO have less 40 or 100° C. viscosity loss than the oils formulated using VI improver (Example 9 and 10). Furthermore, Example 7 and 8 oils have much lower loss of VI as shown in Table 3. This set of data indicated that oils with the new HVI-PAO at similar or even high viscosity have better shear stability than oils with commercial VI improver.

TABLE 3

Lube properties of semi-synthetic hydraulic oils

| | Example | | | |
|---|---|---|---|---|
| | 7 | 8 | 9 | 10 |
| Wt % Sample 2 HVI-PAO | 20 | 30 | 0 | 0 |
| Wt % VI Improver (a) | 0 | 0 | 6 | 7.5 |
| Wt % Conventional Mineral Oils (b) | 80 | 70 | 94 | 92.5 |
| Visc at 40° C., cSt | 45.2 | 96.6 | 44.71 | 44.72 |
| Visc at 100° C., cSt | 8.0 | 14.4 | 7.7 | 8.0 |
| VI | 152 | 153 | 142 | 153 |
| After TRB test | | | | |
| Visc at 40° C., cSt | 38.32 | 86.40 | 39.34 | 39.35 |
| Visc at 100° C., cSt | 6.96 | 12.28 | 6.42 | 6.66 |
| VI | 144 | 137 | 117 | 122 |
| % 100° C. Vis Loss | 13 | 14 | 17 | 17 |
| % 40° C. Visc Loss | 15 | 14 | 17 | 17 |
| Δ VI loss | 8 | 18 | 25 | 31 |

(a) The VI improveris a conventional methylmethacrylate polymer.

(b) The mineral oil is a combination of a 4 cS paraffinic solvent dewaxed base stock and a 3 cS naphthenic base stock

V. Synthetic Industrial Circulation Oil

Synthetic industrial circulation oils, Examples 11 to 14, of vis grade ISO 460 were formulated using the HVI-PAO from Sample 2, above, or with a conventional PAO with highest available viscosity, SpectraSyn™ 100, together with 20 wt % of a polar base stock, an alkylated naphthalene Synesstic™ 5, also available from ExxonMobil Chemical Co. The formulation also contains 1.75 wt % of an additive package commonly used by lube formulators containing proper balanced amount of amine and phenolic antioxidants, anti-wear and extreme-present additives comprising ZnDDP, cresyl phosphates, phosphates or phosphonates, dispersant, detergents, corrosion inhibitors, metal passivators, demulsifier for improved water separability, clarifying agents to improve clarity, and colorant. The final viscosities of these formulations all met the specification of IS0460 vis grade. Examples 11 and 12 compare formulations with HVI-PAO vs. conventional PAO when no defoamant is added to the finished formulation. Example 13 and 14 compare formulations with HVI-PAO vs. conventional PAO when 200 ppm of an defoamant DCF200 available from Dow Chemical Co. in a pre-prepared package was added. Other additive components are identical.

The example 11 oil, when tested in Mixmaster Foam Test described earlier in the test description section, showed 16% foam volume at 0 minutes after agitation was stopped and 0% foam volume 5 minutes after agitation was stopped.

In comparison, when a similar ISO 460 synthetic circulation oil was formulated using conventional high viscosity PAO (Example 12, Table 4), the initial foam volume was 40% at 0 minutes after agitation was stopped. The foam volume remained at 38% at ten minutes after agitation was stopped. This shows that the new HVI-PAO based oil is less foaming. In a similar formulation, when 200 ppm of a typical commercial silicone defoamant DCF 200 from Dow Chemical Co. was added to the formulation, the circulation oil formulated with the new HIV-PAO (Example 13, Table 4) still have much less foam than the conventional PAO-based oil (Example 14, Table 4).

TABLE 4

Lube properties of synthetic circulation oils

| | Example | | | |
|---|---|---|---|---|
| | 11 | 12 | 13 | 14 |
| Wt % Sample HVI-PAO(a) | 78.25 | 0 | 78.25 | 0 |
| Wt % conventional PAO(b) | 0 | 78.25 | 0 | 78.25 |
| Defoamant concentration, ppm(c) | 0 | 0 | 200 | 200 |
| Wt % other base stock(d) | 20 | 20 | 20 | 20 |
| Wt % additives(e) | 1.75 | 1.75 | 1.75 | 1.75 |
| % Foam Volume | | | | |
| At 0 minutes after mixing stopped | 16 | 40 | 5 | 28 |
| At 5 minutes after mixing stopped | 0 | 38 | 0 | 23 |

(a)HVI-PAO used in these experiments contain 22.25 wt % Sample 1 HVI-PAO and 56 wt % Sample 2 HVI-PAO (b)Conventional PAO used in these experiments contain 20 wt % 40 cSt PAO and 58.25 wt % 100 cSt PAO, both are available from ExxonMobil Chemical Co.

(c)The defoamant is DC200 from Dow Chemical Co., a polysilozane polymer of 60,000 molecular weight (d)The other base stock used is a 5.5 cSt di-basic ester fluid available from ExxonMobil Chemical Co.

(e)The additive package used in this formulation contains typical antioxidant, metal deactivator, anti-rust and anti-wear additives in proper balanced amount A typical additives package can be found in U.S. Pat. No. 6,180,575.

When tested in a cone drive worm gear, the Example 11 oil showed a higher savings benefits than comparative Example 12 oil, as summarized in following table. More discussion and references about this test can be found in Journal of Synthetic Lubrication, Vol. 1, No. 1, April 1984, page 6:

| | % Benefit relative to mineral oil by Example 11 oil | % Benefit relative to mineral oil by Example 12 oil - comparative sample |
|---|---|---|
| At 100% load | 11.8 | 11.0 |
| At 150% load | 10.0 | 9.6 |

The following set of experiments demonstrated that the Example 13 oil based on this invention had much better foaming property even when oil was severely aged relative to the non-HVI-PAO basestock. In this set of experiments, Example 13 and 14 oils were aged by cycling the oil (60 ml/hour) through an autoclave with air (100 cc/minute) at 200° C., 250 psi and 3500 rpm. This process simulated the aging process of oil during severe operation for extended time. During this accelerated aging process in the autoclave, oil viscosities increased and samples were take from the autoclave to measure their properties, especially regarding the foaming properties. The % foam volumes for each oil aged for different time were summarized in the following tables. As these data demonstrated that Example 13 oils have much less foam even after severe aging. Even after more than 60 hours of oxidation, the oil still has less foam, 5 ml, than the comparative example 14 without any aging which has a foam volume of 28 ml at the same foam testing time.

| Aging time, hrs | 0 (fresh sample) | 7.8 | 27.8 | 47.1 | 67.1 |
|---|---|---|---|---|---|
| Foam volume* for Example 13 | 0 | 0 | 8 | 5 | 5 |

| Aging time, hrs | 0 (fresh sample) | 14.6 | 30.9 | 50.4 |
|---|---|---|---|---|
| Foam volume* for Example 14 | 28 | 48 | 53 | 56 |

*Foam volume was measured 5 minutes after agitation was stopped.

The following set of experiments demonstrated that the oil based on the HVI-PAO are more resistant to foaming even after it is badly contaminated with other aged oil or with impurity. When a known contaminant, a used and aged marine engine oil Mobilgard 570, 0.5 wt %, was added to Example 13 oil, the foam volume (5 minutes after agitation stopped) increased from 0% to 2%. When the same contaminant was added to Example 14 oil, the foam volume increased from 23% to 47% —a much bigger increase than Example 13 oil.

Wide cross-graded synthetic automotive gear oils were also formulated using the Sample 2 HVI-PAO versus conventional high viscosity PAO, SpectraSyn™ 100 available from ExxonMobil Chemical Co. (Table 5, example 17 to 20). In this formulation, in addition to the PAO or HVI-PAO base stocks, other base stocks with higher polarity, especially Group V base stocks, including esters or alkylated aromatics of lower viscosity 1.3 to 6 cS, are also added. The amount of each base stock used in the final formulation is adjusted to achieve same viscosity at 100° C. In this formulation, 9-10 wt % of proper balanced amount of additives is also used. The additive package usually include anti-oxidants, anti-wear and extreme pressure additives, rust and corrosion inhibitors, friction modifiers, defoamants, viscosity modifiers, dispersants and detergents, etc. As the data demonstrated that the gear oil based on HVI-PAO have much higher VI and lower low temperature Brookfield viscosity at −40° C. This high VI and low viscosity at low temperature is beneficial for energy efficiency and wear protection.

TABLE 5

Lube properties of synthetic automotive gear oils

| | Example | | | |
|---|---|---|---|---|
| | 17 | 18 | 19 | 20 |
| Vis grade | 75W-90 | 75W-90 | 75W-140 | 75W-140 |
| Wt % HVI-PAO | 53.4 | 0 | 60 | 0 |
| Wt % conventional PAO | 0 | 54.2 | 0 | 60 |
| Wt % other base stock | 36.3 | 36.3 | 30 | 30 |
| Wt % additives | 9.3 | 9.3 | 10 | 10 |
| Visc at 100° C., cSt | 15.7 | 15.7 | 24.8 | 26.3 |
| VI | 174 | 151 | 203 | 174 |
| Pour point, ° C. | <−65 | −55 | <−65 | −55 |
| Brookfield viscosity @ −40° C., cP | 61,500 | 116,600 | 54,000 | 147,600 |

A synthetic paper machine oil formulated using the new HVI-PAO (Example 21) had much lower foaming tendency than the comparative oil formulated with conventional high vis PAO, SpectraSyn™ 100 available from ExxonMobil Chemical Co. (Example 22), Table 6. In a ASTM foam test (D892 method), Example 21 generated much less initial foam volume and settling foam volume than comparative Example 22 at 24°, 93.5° and 24° C. in Sequence 1, 2 and 3 tests.

TABLE 6

Properties of synthetic paper machine oils

| | Example | |
|---|---|---|
| | 21 | 22 |
| Wt % HVI-PAO | 52.0 | 0 |
| Wt % conventional PAO | 0 | 48.5 |
| Wt % other base stock | 45.15 | 48.4 |
| Wt % additives | 2.85 | 3.1 |
| Visc at 100° C., cSt | 31.37 | 26.22 |
| Visc at 40° C., cSt | 244.3 | 232.5 |
| Foam by ASTM D892 method | | |
| Seq 1 (ml/min/ml) (a) | 250/9.15/0 | 600/10/360 |
| Seq 2 (ml/min/ml) (b) | 80/1.24/0 | 216/1.53/0 |
| Seq 3 (ml/min/ml) (c) | 210/10/10 | 550/10/135 |

(a) - 24° C.,
(b) - 93.5° C.,
(c) - 24° C.

These examples demonstrated that HVI-PAO can be used broadly in many industrial oil and greases with performance advantages over conventional lube compositions.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The invention has been described above with reference to numerous embodiments and specific examples. Many variations will suggest themselves to those skilled in this art in light of the above detailed description. All such obvious variations are within the full intended scope of the appended claims.

We claim:

1. A formulated industrial oil, said oil having an ISO viscosity grade of 2 to 46,000 and comprising:

(a) 1 to 95 wt % of at least one HVI-PAO;

(b) 5 to 50 wt % of at least one first basestock selected from Group I basestocks having a viscosity range of from 3 cSt to 50 cSt, Group II and Group III hydroprocessed basestocks, and a Group IV PAO having a VI of about 130 or less; and (c) 1 to 50 wt % of a second basestock selected from Group V basestocks.

2. The formulated industrial oil according to claim 1, said oil does not contain any added polymeric thickeners or VI improver.

3. The formulated industrial oil according to claim 1, wherein said HVI-PAO is obtained by oligomerizing at least one alpha olefin using a catalyst selected from reduced metal oxides, metallocenes, and Zeigler-Natta catalyst.

4. The formulated industrial oil according to claim 1, further comprising at least one additive selected from anti-oxidants, anti-wear agents, extreme pressure agents, defoamants, detergent/dispersant, rust and corrosion inhibitors, and demulsifiers.

5. The formulated industrial oil according to claim 1, wherein said HVI-PAO is characterized by a viscosity index (VI) greater than 160, as measured by ASTM D2270, and by at least one of the following: a branch ratio of less than 0.19, a weight average molecular weight of between 300 and 45,000, a number average molecular weight of between 300 and 18,000, a molecular weight distribution of between 1 and 5, a pour point below −15° C., a bromine number of less than 3, a carbon number ranging from C30 to C1300, and a kinematic viscosity measured at 100° C. ranging from about 3 cSt to about 15,000 cSt, as measured by ASTM D445.

6. The formulated industrial oil according to claim 1, wherein said Group V basestock is selected from alkylated aromatics, polyalkylene glycols, esters, and mixtures thereof.

7. The formulated industrial oil according to claim 1, wherein said Group V basestock is present in the amount of about 1 to 20 wt %.

8. The formulated industrial oil according to claim 1, wherein said Group V basestock is present in the amount of about 5 to 25 wt %.

9. In an apparatus comprising a rolling element bearing lubricated by an industrial oil, the improvement comprising an oil according to claim 1.

10. In a gear system, circulation lubrication system, hydraulic system, compressor system, vacuum pump, metal working machinery, electrical switch or connector comprising a lubricating oil, the improvement comprising an oil according to claim 1.

11. The formulated industrial oil according to claim 1, wherein (a) said HVI-PAO is present in the amount of 15 to 50 wt %, (b) said first basestock is present in the amount of 5 to 50 wt %, and (c) said second basestock selected from Group V basestock is present in the amount of 5 to 50 wt %.

12. The formulated industrial oil according to claim 11, wherein said first basestock is a Group IV PAO having a VI of about 130 or less.

13. The formulated industrial oil according to claim 11, wherein no polymeric thickeners or VI improver is added.

* * * * *